United States Patent [19]

Steidinger

[11] 4,095,695

[45] Jun. 20, 1978

[54] STUFFED SEALED ENVELOPE ASSEMBLY AND METHOD OF MAKING

[75] Inventor: Donald J. Steidinger, Barrington, Ill.

[73] Assignee: Wallace Business Forms, Inc., Hillside, Ill.

[21] Appl. No.: 788,273

[22] Filed: Apr. 18, 1977

[51] Int. Cl.[2] ..... B65D 27/34

[52] U.S. Cl. ..... 206/610; 229/69

[58] Field of Search ..... 229/69, 85; 206/610

[56] References Cited

U.S. PATENT DOCUMENTS

| | | | |
|---|---|---|---|
| 3,104,799 | 9/1963 | Steidinger | 229/69 |
| 3,339,827 | 9/1967 | Steidinger | 229/69 |
| 3,554,438 | 1/1971 | Von Malderghem | 229/69 |
| 3,777,971 | 12/1973 | Steidinger | 229/69 |
| 3,837,565 | 9/1974 | Johnsen | 229/69 X |
| 3,941,308 | 3/1976 | DiGirolomo et al. | 229/69 |

FOREIGN PATENT DOCUMENTS

| | | | |
|---|---|---|---|
| 790,434 | 7/1968 | Canada | 229/69 |
| 937,905 | 12/1973 | Canada | 229/69 |

*Primary Examiner*—Stephen P. Garbe

*Attorney, Agent, or Firm*—Tilton, Fallon, Lungmus & Chestnut

[57] ABSTRACT

A series of connected, stuffed sealed envelope assemblies, i.e., "mailers" and method of making wherein the insert plies are each rectangular and along one edge thereof having an integral attaching portion which is secured to either the envelope front or back at a location inward of the adjacent control margin.

11 Claims, 7 Drawing Figures

STUFFED SEALED ENVELOPE ASSEMBLY AND METHOD OF MAKING

BACKGROUND AND SUMMARY OF INVENTION:

This invention relates to a series of connected stuffed sealed envelope assemblies and method of making the same, and, more particularly, to a method and article which overcome the drawbacks of the prior art.

A widely used mailer is that described in U.S. Pat. No. 3,104,799. This featured a series of connected stuffed, sealed envelopes which are made from continuous webs of paper by a forms manufacturer. At the time of manufacture, certain information or indicia common to all of the envelope assemblies can be printed on the webs, viz., the name of the sender, a framework or pattern for the inscribing of invoice information, etc. These assemblies are zig-zag folded and shipped to a user (frequently a manufacturer) who operates a computer to print invoice information or the like through the envelope onto the interior plies. Thereafter, the assemblies are separated one from another and mailed to the manufacturers' customer. Thus, there are three distinct phases in the life of a mailer assembly where operation can be optimized: manufacture, computer printing, and recipient handling.

At the outset, it should be appreciated that this is a large volume business: the three largest business form companies in the U.S. plus a number of smaller companies produce about a billion mailer forms annually, representing many millions of dollars of sales. Thus, anything that can be done to conserve on paper usage can be meaningful — even though the savings per form might seemingly be slight.

Another problem or challenge associated with the manufacture of mailer forms is the need for registration or alignment of the control margins of the various plies. The control margins are the widely employed ½ inch wide integral portions along the longitudinal sides of each web that are equipped with line holes. The line holes are engaged by pin belts for advancing the various webs during manufacture and in the subsequent usage for computer printout are engaged by similar pin belts for advancing the webs at intermittent, high speed. Normally, the pins have a diameter of 0.150 inches while the line holes are normally 0.156 inches, yielding a small clearance of 0.006 inches. When a number of plies are assembled, small misregistrations or misalignments in the various webs during manufacture can create a problem during the computer printout. It will be immediately apparent that the more plies that must be aligned, the greater the problem of keeping the line hole openings clear enough for the pins. Hence, manufacturing speeds have had to be limited in order to get proper alignment of the line holes in the various plies. It will be appreciated that small misalignments occurring during the laying down of the various webs one on another can, in the aggregate, seriously reduce the net line hole opening so that when the mailer form is advanced to the computer, there is faulty engagement and possible stoppage of work. This frustrates one of the principal advantages of mailer forms, i.e., high speed, continuous computer printout.

A third problem or challenge that exists during the manufacturing operation and which has a definite effect during the use thereof in conjunction with the computer printout is the phenomenon of "tenting". Tenting is a condition which results when several plies of paper (which have been fastened rigidly by gluing) are folded. The innermost ply has the shortest path. Each outer ply must be folded around a larger radius — with the result that a misregistration occurs, i.e., a given position on one ply does not correspond to the same position on another ply. This occurs particularly when the glue dries, after folding.

If the glue dries before folding, as might be accomplished by running at slow speeds or using hot melt glues, then the problem is different. First, some tenting occurs because the different radius problem still exists. Secondly, some tearing of the cross perforation ties occurs which helps relieve stress. If the ties are wide enough to start with, enough strength remains. Third, that portion of the difference in radius path which is not absorbed because of tenting or cross perforation tie tearing shows up in a fluffiness of the pack due to the unequal length of the various plies between folds. This fluffiness (the pack of forms does not lie flat and solid) results in wrinkles that become ironed into the plies by the weight of the pack and tight packing in the carton — resulting in an unacceptable appearance.

This misregistration is particularly serious when it is understood that mailers are printed from the outside, i.e., from the envelope front. This unavoidable misregister becomes even more disadvantageous when the form is unfolded, incident to feeding through computer printout equipment. The outer plies that follow the longer path can no longer slide back into register because the glue is fully dried while the forms are in the folded pack so that they form a peak that sticks up, giving the business form a much greater thickness at that point. The peak interferes at the computer pin feeding mechanism, causing jam-ups, tearing of forms, and even damage to the computer equipment.

Another problem exists in the need for maintaining a fairly close register of the various plies within the mailer. Should one of the plies shift relative to the others, the printout information will fall in an improper location, possibly vitiating the usefulness of the entire mailer.

Still another problem exists when the mailer is received by the intended recipient. By the time the mailer is sent through the mails, the control margins have usually been removed so the recipient gets an envelope which is characterized by a line of perforation along one side. Normally this line of perforation is characterized by a thumb-notch so that when the small strip is removed from the envelope side or end, a portion of the interior plies is exposed through the thumb notch for convenience in removal. Some mailers provide this feature but others by virtue of their construction and method of manufacture are inherently incapable of providing this advantageous opening mechanism. Thus, depending upon the particular form, the recipient may mutilate or even destroy the mailer and its contents in the attempt to open the same. This may result in the loss of a return envelope or other important information. Manifestly, it would be desirable to provide a foolproof opening feature in a mass produced, mass inscribed mailer.

In some instances, those in the art have tried to achieve registration by employing a perforated connection on the insert plies at the end thereof opposite the tear strip. When this feature is employed, the manufacturer usually tries to instruct the recipient to "snap out" the inserts, a procedure that can be made to work by those only having experience and practice. Most recipients do not have this experience and practice so they do the most natural thing. They tear off the opening (tear off) strip. This leaves the inside plies still attached to the opposite end. No matter how weak the ties of the perforations are, the inside plies do not come out when the recipient pulls on them in the natural way. His reaction tends to be that something is wrong with the form and in frustration, pulls on them rather sharply. If the perforation bonds or ties are weak enough, the plies do come out but in many cases, the inside plies tear. Even further with this construction, the perforations on the opposite side are made with a rotary wheel that cuts the paper except where a notch in the cutter results in a tie or bond (uncut portion). It is not possible to position this tie in relation to the form by this method. The tie comes every so often but falls in a random location on the form. If on a given form the location of the tie is in a disadvantageous location (too near the top or bottom of the inside ply) an increased danger exists of tearing of a corner of the ply. Thus, in attempting to solve certain problems, other problems were introduced.

None of the prior art mailers has solved all of the foregoing problems. For example, the wiidely employed mailer of prior U.S. Pat. 3,104,799 does achieve inside ply registration and foolproof openability (on one wide forms) but lacks the advantageous characteristics of conserving paper, achieving line hole registration and avoidance of tenting. On the very popular two-wide forms (printed two-wide at the computer), the foolproof openability of the U.S. Pat. No. 3,104,799 patent does not exist. On two-wide forms made in accordance with the U.S. Pat. No. 3,104,799 patent teaching, the opposite end is tied with perforations on one side of the two-wide form.

A second prior art U.S. Pat. No. 3,339,827 shows two attempts to overcome the tenting problem. One attempt provides that the plies inside be individual pieces of paper, smaller in both width and length in the envelope and not continuous. However, this was done at the expense of ply registration — a substantial spacing being required to avoid connecting the inside plies to the glue lines. A second attempt in the U.S. Pat. No. 3,339,827 patent utilizes a very weak "frangible" glue to hold the smaller individual plies in the envelope in place. The glue must be very weak in order to extract the plies inside conveniently and without tearing them. If it is too weak, it fails to hold the plies in register. If there is more than one ply inside, the glue appears on the face of some of the inside plies which is objectionable to the user and recipient — and if carbon plies are required between the inside plies the glue does not stick to the waxy side of the carbon ply. Because of these drawbacks, the U.S. Pat. No. 3,339,827 patent structure has been used very limitedly — it has not been considered suitable where the mailer has a number of inside plies.

The seriousness of the registration of the inside plies was addressed by the structure shown in prior U.S. Pat. No. 3,777,971 in which embossments were provided in the back ply of the envelope to restrict the movement of the loose plies inside. Although the movement of the plies inside can be more limited than when only the peripheral glue lines are used (as in the U.S. Pat. No. 3,339,827 patent), practical commercial tolerances in the location of the embossments, the placement of the inside plies in manufacture and their movement under inertia forces of the stop and start indexing of the computer pin feed mechanism, results in more misregistration than is desired of the plies inside — particularly at the moment of computer printout.

Another possible approach to the solution of the various problems outlined above can be found in Canadian Pat. No. 937,905. This patent discloses an envelope assembly where the insert material is shorter than the envelope so as to avoid tenting but teaches that both ends of the insert plies are adhesively secured in the control margins — this ostensibly to avoid the problem of misregister. However, this requires the use of more paper, does not solve the problem of pin hole misregister, and does not provide for the convenient foolproof manner of opening necessary to optimize the use of mailers. The teaching of the Canadian Pat. No. 937,905 patent is an extreme one to solve the inside ply registration problem. It gains the possibility of cross chip paper savings but adds to the wastepaper on at least one side. It does not solve the pin hole register problem nor does it solve the foolproof opening on either one wide or two-wide forms. Because this patent does not mention material savings attributed to the cross chip area, the implication is that the form was made by having the inside plies equal in length to the envelope plies (in continuous webs) and then having the chips cut out, the common method for mailer production.

Through the instant invention, all of the foregoing problems or challenges are met and solved. In one preferred form of the invention, the mailer has the front and back plies adhered together along the transverse lines between adjacent assemblies and also along a longitudinally extending line inward of one of the control margins, the periphery of the insert material being spaced inwardly from the three just mentioned lines of adhesive. The assembly is further characterized by aligned lines of perforation in each of the plies which extend parallel to but are spaced within 1 inch inwardly of the other control margin so as to define an attaching portion in the insert ply. Still further, adhesive means are provided adjacent the other of the control margins and spaced inwardly thereof joining the front and back plies together and the attaching portion to at least one of the front and back plies.

With this construction and the method of making, there is a distinct saving in paper (both in the "chip" area and width), there is an avoidance of the misalignment of the line holes, tenting is avoided, register is achieved in all of the plies and the advantageous foolproof opening achieved — this on both one and two wide forms. Further, an additional accrues during manufacture because small misregisters can be tolerated in the individual insert plies without affecting the computer operation — thereby permitting higher speeds of manufacture not reliably realized in the prior art constructions.

Other objects and advantages may be seen in the details of construction, manufacture and operation set forth in the ensuing specification.

DETAILED DESCRIPTION:

The invention is described in conjunction with the accompanying drawing, in which FIG. 1 is a perspective view of an embodiment of the invention with portions of the various plies separated to illustrate the invention;

Figure 1:
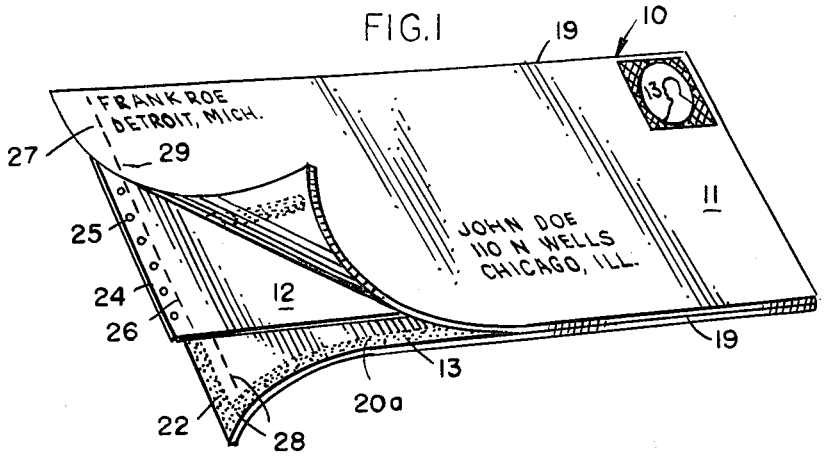

Referring now to FIG. 1, the numeral 10 designates generally a completed envelope assembly constructed according to the teachings of this invention. As illustrated, the envelope assembly 10 includes an envelope front 11, an insert ply 12 and an envelope back 13. It will be immediately appreciated that different numbers of insert plies 12 can be employed in the practice of the invention and that the single insert ply 12 is illustrated merely for the sake of convenience and clarity. For example, currently the single insert ply type of form constitutes only about 20–25% of the total volume of mailers produced annually. The more popular size includes three insert plies where one of the plies is an invoice and the two other plies are joined together to form a return envelope, i.e., a convenience for the recipient to return his check.

In accordance with the basic principle of mailers, the recipient information is printed through the envelope front 11 and for this purpose, carbon (not shown) is interposed between the back face of the envelope front and the insert ply — and between other insert plies if the same are employed. The provision of carbon usually takes one of two forms — either as a carbon "flimsy", i.e., a very light-weight sheet coated with carbon, or the back face of the envelope front 11 itself is coated with carbon in appropriate areas to transfer the recipient information.

Figure 2:
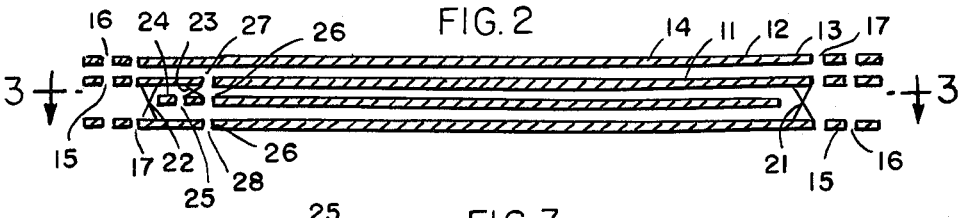
FIG. 2 is a schematic cross sectional view of a mailer form in the condition it exists prior to computer printout.

Referring now to FIG. 2, the same three plies 11–13 are seen in company with an overlying ply 14. Conventional practice provides this topmost ply as the office copy of the information printed on the business form mailer. This is retained by the sender — thus, the showing in FIG. 1 illustrates generally the form of the mailing piece as it leaves the sender and is received by the recipient.

Figure 3:
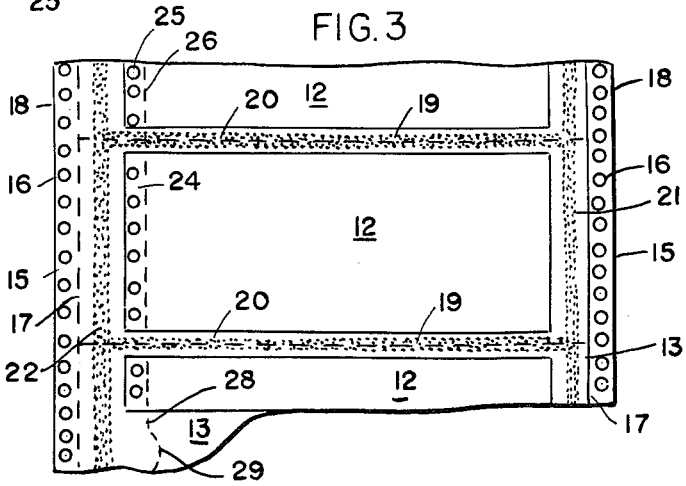
FIG. 3 is a fragmentary sectional view such as would be seen along the sight line 3—3 of FIG. 2.

Referring now to FIG. 3 (which is a sectional view taken along the line 3—3 applied to FIG. 2) this shows the connected series of envelope assemblies as they are produced by the business form manufacturer. It will be appreciated that mailers are normally provided by the manufacturer in a connected series of 500, 1,000, etc. forms for the manufacturer's customer to process through a computer.

During the course of manufacture of the mailer forms, the envelope back 13 is equipped with control margins 15 These control margins 15 are equipped with line holes 16 which are utilized by pin belts both during the manufacture and use in the computer printer. Ultimately, the control margins 15 are removed and for this purpose a longitudinally extending line of weakening or perforation as at 17 is introduced into the connected envelope assemblies. Thus, the control margins 15 extend between one longitudinal edge 18 (still referring to FIG. 3) and the just-mentioned line of perforation 17.

Additionally, during manufacture, transverse lines of weakening or perforation as at 19 are provided at longitudinally spaced points to define each envelope 10. For example, the top and bottom edges of the envelope 10 as seen in FIG. 1 are defined by the lines 19 and this is so indicated in FIG. 1.

To hold each envelope assembly in sealed condition, various bands of adhesive are laid down. For example, a band of adhesive 20 (of sufficient width to overlie and straddle the perforation line 19) is laid down transversely of the continuous web either constituting the series of envelope backs 13 or the envelope fronts 11. Thus, when a single envelope 10 is detached from the continuous assembly (as by "bursting") along the perforation line 19, a portion of the adhesive band 20 remains. This is designated by the numeral **20*a*** in FIG. 1.

The transversely extending bands of adhesive 20 extend sufficiently to merge with the longitudinally extending bands of adhesive which close the four sides of the envelope. For example, (and still referring to FIG. 3) a longitudinally extending band of adhesive 21 is provided adjacent the right hand edge of the insert ply 12. Normally, this is a continuous band of adhesive running the length of the web providing the envelope backs 13 or fronts 11. The longitudinally extending band of adhesive 21 is normally positioned a slight distance inwardly of the control margins 15 (see FIG. 2). To secure the office ply 14 to the remaining plies, the various plies making up the control margin, i.e., the plies 14, 11 and 13 as shown, are advantageously crimped in the narrow band constituting the control margins 15.

Referring to the left hand portion of FIG. 2, it will be noted that the line holes 16 are provided in each of the plies equipped with the control margins 15, i.e., the plies 14, 11 and 13, as illustrated. The longitudinal line of perforation 17 is indicated only with reference to the bottom most ply 13, but it will be appreciated that inasmuch as these lines of perforation 17 are applied to the assembled plies, they exist in all plies having the control margins 15.

Spaced inwardly of the left hand control margin, i.e., the line of perforation 17, is another longitudinally extending band of adhesive designated 22 in FIGS. 1 and 2. This connects the envelope front ply 11 with the envelope back ply 13. Another longitudinally extending band of adhesive 23 (see the left hand portion of FIG. 2) connects the upper face of the insert ply 12 with the envelope front ply 11. Thus, the insert ply 12 is completely immobilized within the envelope made up of the front and back plies 11 and 13.

Reference to FIGS. 1–3 reveals that the extreme left hand portion 24 (viz., the "attaching portion") of the insert ply 12 is equipped with line holes 25. These line holes 25 are employed during manufacture of the envelope assemblies to guide the continuous web ultimately constituting the insert plies 12 into place over the web providing the envelope backs 13. The web which provides the insert ply 12 is transversely severed into rectangular portions incident to being laid down on the web providing the envelope backs 13 and thus, the line holes 25 provides a means for controlling the handling of the web up to the time of laying down the same.

Prior to laying down the insert plies 12 on the web 13, the web providing these plies 11 is equipped with a longitudinal line of perforation 26. This is positioned in alignment with corresponding lines of perforation provided in the envelope front as at 27 and the envelope back as at 28 (see FIG. 1). Advantageously, in accordance with conventional practice, the lines of perforation 27 and 28 may be equipped with thumb notches at at 29 — see the lower left hand portion of FIG. 3. Thus, when the assembly made up of the plies 11–13 is torn along the lines 26–28, the insert ply 12 is released from its capture between the plies 11 and 13 and a small crescent shaped portion on the ply 12 projects through the thumb notch 29 for ease of removal.

With the just-described construction, it is apparent that considerable material savings are realized over the prior art. No longer are "chips" required to be removed from the web providing the plies 12 as was the case in the U.S. Pat. No. 3,104,799 patent. Further, material is also saved along both marginal edges inasmuch as the insert plies terminate short of the control margins 15. Typically, at least ½ is saved at the left and ¾ inch at the right. The paper savings on the most popular mailer size (5 ½ inches × 9 ¾ inches) with one outside ply and three inside plies over the construction of U.S. Pat. No. 3,104,799 is approximately 10.6% of the total paper used and 21.7% of the inside plies. It should be appreciated that paper and carbon tissue cost is approximately 50% of the selling price of business forms.

Figure 4:
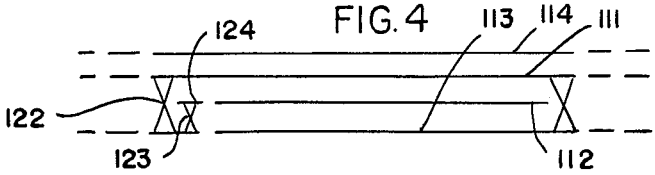
FIG. 4 is a schematic cross sectional view of a modified form of the invention.

It will be appreciated that variations in the locations of the adhesive bands can be made while still achieving the benefits of the invention. For example, in FIG. 4, which illustrates a modified form of the invention, the front and back plies 111 and 113 are secured at the left hand side thereof by a band of adhesive 122 in the same manner as that illustrated in FIG. 2. However, the insert ply 112 is connected to the back ply 113 by the adhesive band 123, rather than the front ply 111 — as is the case with the form of the invention shown in FIG. 2. Also, in FIG. 4, the line holes 25 are omitted from the attaching portion 124. For example, the attaching portion 124 can be somewhat wider at the beginning of manufacture (to accommodate the line holes) and then a portion trimmed just prior to laying the web containing the plies 112 down on the web constituting the backs 113.

Figure 5:
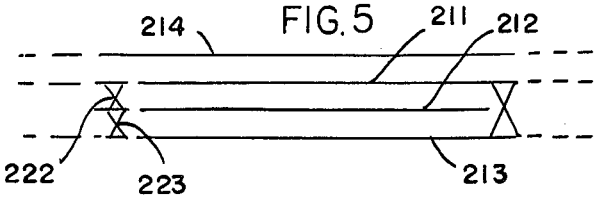
FIG. 5 is a schematic cross-sectional view of another modified form of the invention.

In FIG. 5, yet another adhesive arrangement is illustrated wherein the top ply 211 is connected to the intermediate ply 212 by adhesive band 222. In turn, the adhesive band 223 secures the intermediate ply 212 to the back ply 213.

To achieve the maximum benefit of the invention, the aligned lines of perforation 27, 26 and 28 (see the left hand portion of FIG. 2) should extend parallel to but spaced within 1 inch inwardly of the control margin 15, i.e., inward of the aligned lines of perforations 17. Further, the attaching portion 24 should terminate inwardly of the control margin 15, more particularly short of the line holes 16 therein. In this fashion, there is no possibility of misalignment of the line holes — it only being necessary to align the holes 16 in the plies 11 and 13.

Figure 6:
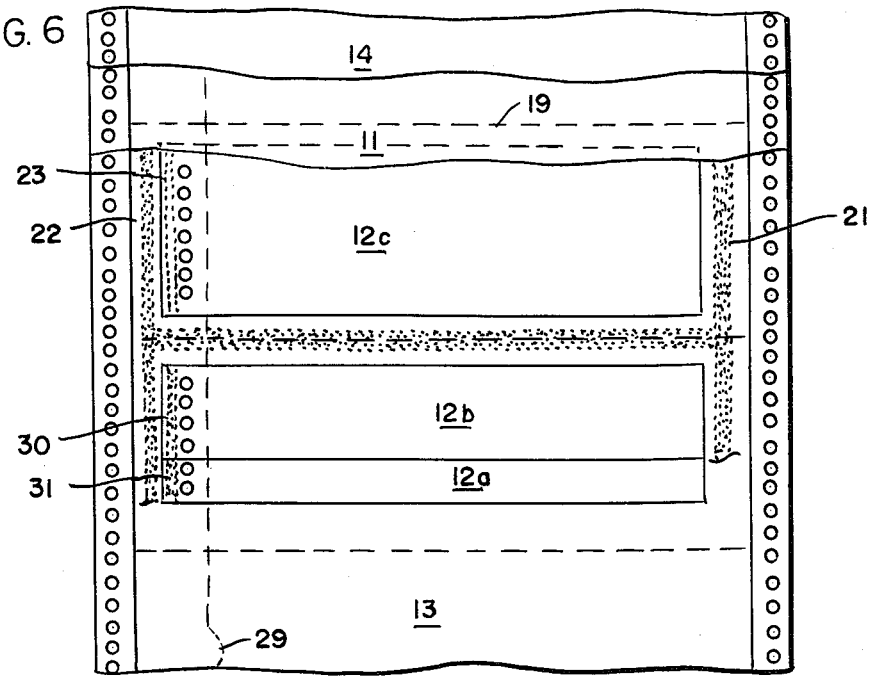
FIG. 6 is a fragmentary plan view of a connected series of stuffed envelopes assemblies, partially broken away to reveal three insert plies; nad

Reference is now made to FIG. 6 which illustrates a connected series of envelope assemblies constructed much the same as that illustrated in FIGS. 1–3 but with the difference of having three insert plies 12*a*, 12*b* and 12*c*. Inasmuch as there are two additional insert plies, it is necessary to provide additional bands of adhesive — as at 30 to interconnect the attaching portions of the ply 12*b* to that of 12*a* and at 31 to attach 12*c* to 12*b*.

Figure 7:
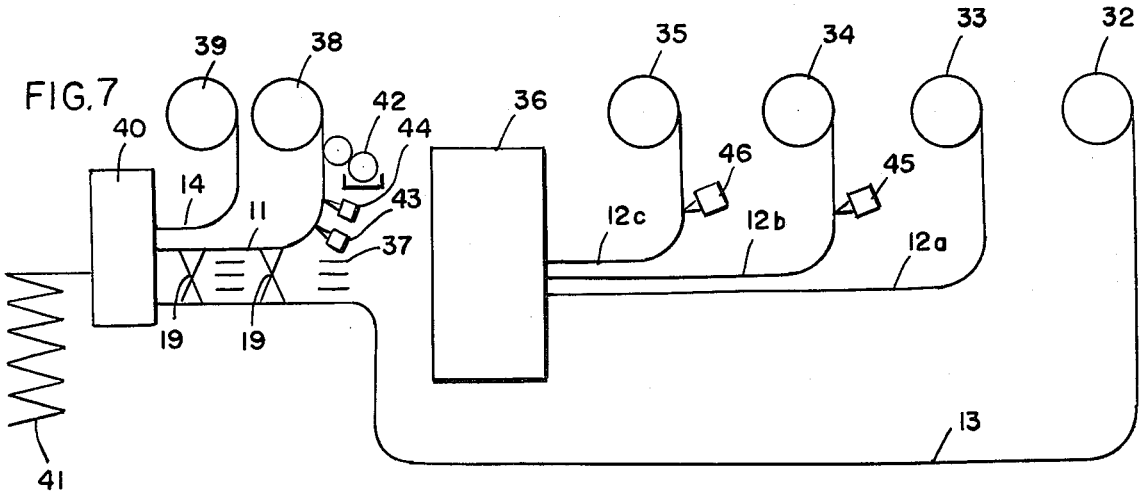
FIG. 7 is a schematic side elevational view of apparatus employed in the manufacture of the mailer form of FIG. 6.

The method for making the mailer of FIG. 6 is illustrated schematically with reference to FIG. 7.

At the extreme right of FIG. 7, the numeral 32 designates a parent roll from which is unreeled the web ultimately constituting the backs 13 of the mailer forms. Parent rolls 33, 34 and 35 provide the intermediate plies 12*a*, 12*b* and 12*c*. Conveniently, the plies 12*a* and 12*b* can be adhesively united incident to the process to form a return envelope. Inasmuch as this procedure is well known, the details thereof are not shown in FIG. 7, thereby making the illustration simpler and clearer. The webs 12*a*, 12*b* and 12*c* are transversely severed by means of a cutoff device 36 and, incident to the cutoff are positioned as a stack of insert plies 37 — see the left central portion of FIG. 7. Thereafter, the envelope fronts are provided from a parent roll 38 and the office copy plies from a parent roll 39. The thus-assembled webs are sent through a cross perforater 40 and thereafter zig-zag folded as at 41.

In the illustration given in FIG. 7, an adhesive applying device generally designated 42 is employed to lay down the transverse bands of adhesive 19 and a glue-applying nozzle 43 is employed to lay down the longitudinally extending bands of adhesive 21 and 22 on the web providing the fronts 11. The longitudinally extending band of adhesive 23 (connecting the top insert ply 12*a* with the web 11) is laid down by another glue applying nozzle 44. Inasmuch as the illustration in FIG. 7 features multiple insert plies, adhesive nozzles 45 and 46 lay down longitudinally extending bands of adhesive 30, 31 for connecting these plies in their corresponding attaching portions, i.e., in vertical alignment with the adhesive band 23.

Advantageously, the line holes 16 are provided in the various webs prior to being rolled into the parent rolls 32, 38, etc. This is conveniently performed on a press (not shown) which operates on the various webs to print the same are required and provide the various longitudinal perforations 17 and 26–28, along with the thumb notches 29.

Thus, in the practice of the invention a first web 13 is advanced along a predetermined path (see the bottom portion of FIG. 7). The web 13 is unreeled from the parent roll 32. Prior to being reeled into the parent roll 32, a web suitable for business form production is equipped with at least one line hole-equipped control margin extending longitudinally thereof along one edge. Preferably, the web has control margins 15 along both longitudinal edges to insure optimum control during processing, computer printout, etc. Further, the web 13, prior to reeling into the parent roll 32 is equipped with a longitudinally extending line of perforation 28 which is spaced inwardly of the control margin 15 and within about 1 inch (25.4 mm.) thereof. Further, the longitudinally extending line of perforation is equipped with the thumb notches 29. The thumb notches are advantageously longitudinally spaced apart a distance equal to the length of each individual envelope assembly. The area between the control margin 15 and the line of perforation 28 provides a space for attachment of the insert plies 12*a*, 12*b* and 12*c*. As illustrated particularly in FIGS. 1–3, the insert ply 12 is equipped with a left hand attaching portion 24 which ultimately is positioned in overlying relation to the space on the bottom continuous web 13 between the line of perforation 28 and the control margin 15.

To this end, one or more parent rolls 33, 34, 35, etc. are provided to supply the insert plies. The insert plies are, like the first web 13, appropriately printed and are equipped with a longitudinally extending line of perforation 26 which is brought into alignment with the line of perforation 28 on the web 13. As indicated previously, the insert plies 12*a*, 12*b*, 12*c* may be equipped with line holes 25 to facilitate the laying down thereof.

Prior to the laying down of the insert plies 12*a*, 12*b* and 12*c*, adhesive is applied in the attaching portion 24. In the illustration given, adhesive is applied to the underside of the insert ply 12*b* by the glue-applying nozzle 45 and to the underside of the continuous insert ply 12*c* by the nozzle 46. This integrates the three insert ply webs 12*a*, 12*b*, and 12*c* (still referring to FIG. 7) into a unit which ultimately will be attached to the top envelope ply 11 — which in turn will be attached to the bottom web 13. Thus, in this form of the invention (as illustrated in FIG. 1–3), there is no band of adhesive on the underside of the lowest insert ply. However, it is possible to position the adhesive bonds in different areas as illustrated by the modifications illustrated in FIGS. 4 and 5. I find it advantageous first to use a "top supply" arrangement as illustrated in FIG. 7 — as contrasted to positioning the parent rolls underneath the collator. In such case, the webs are most advantageously unreeled as illustrated in FIG. 7 and the adhesive applied to the underside of the appropriate web and the same then are passed under suitable idler rolls (not shown) but which are positioned where the webs change their direction of travel from vertical to horizontal. This avoids the need for having additional machinery to keep the now adhesive-equipped web from contacting any rolls prior to assembly into the final continuous envelope.

After the insert ply webs 12*a*, 12*b*, 12*c* are integrated by the bands of adhesive provided by the nozzles 45 and 46 (corresponding in position to the adhesive band 23) (see FIG. 2), the now connected webs are passed through a cutoff device 36 which provides the transverse edges of the various insert plies. The sub-assembly consisting of the insert plies 12*a*, 12*b*, 12*c* thus becomes a stack 37 which is laid down on the continuous web 13. Immediately after a stack 37 is laid down on the web 13, the web 11 is laid down on top of the stack 37 to confine the same in place. The web 11, as indicated previously, is unreeled from the parent roll 38 which like the previously referred to webs is appropriately printed and equipped with a longitudinally extending line of perforation 27. Also prior to reeling of the web 11 into the parent roll 38, the web is equipped with at least one control margin 15.

Incident to the unreeling of the web 11 from the parent roll 38, transverse lines of adhesive 19 are applied to the web 11 by the adhesive applying device 42. Immediately thereafter and prior to contact with each stack 37, the web 11 is equipped with three longitudinally extending bands of adhesive 21–23. The bands 21 and 22 are continuous and located immediately adjacent the control margins 15, being provided by the glue applying nozzle 43. The intermittent band of adhesive 23 (to secure the top most insert ply 12c to the underside of the web 11) is applied by the nozzle 44.

Thereafter the office copy web 14 (also previously printed and equipped with control margins), is laid down on top of the web 11. Incident to the provision of the transverse perforations 20 (as by the cross perforator 40) the control margins in the webs 11, 13 and 14 are crimped together. Thereafter, the continuous web assembly with the separate stacks of insert plies 37 adhered interiorily thereof are zig-zag folded as at 41. As such, they are then in condition for packaging and shipment to the user for computer printout.

While in the foregoing specification a detailed description of the invention has been set down for the purpose of illustration, many variations in the details hereingiven may be made by those skilled in the art without departing from the spirit and scope of the invention.

I claim:

1. An elongated assembly having a series of connected stuffed sealed envelopes comprising:

superposed continuous plies having outer side edges constituting control margins, said control margins being equipped with longitudinally aligned, spaced apart line holes, said plies defining between said control margins fronts and backs of sealed envelopes, a rectangular insert ply within each sealed envelope, said sealed envelopes being defined by transverse lines of weakening in the front and back plies for separating the sealed envelopes from the assembly, lines of adhesive securing said front and back plies together along said transverse lines and along a longitudinally extending line inward of one of said control margins, the periphery of said insert ply being spaced inwardly from said lines of adhesive, aligned lines of perforation in each of said front, back and insert plies extending parallel to but spaced within 1 inch (25.4 mm.) inwardly of the other of said control margins and defining an attaching portion in said insert ply, said attaching portion adjacent said other of said control margins terminating short of the line holes therein, and adhesive means adjacent said other of said control margins and spaced inwardly thereof joining said front and back plies together and said attaching portion to at least one of said front and back plies.

2. The structure of claim 1 in which said attaching portion is equipped with longitudinally spaced apart line holes.

3. The structure of claim 1 in which said adhesive means includes a first band joining said front and back plies directly together and a second band joining said insert ply to one of said front and back plies.

4. The structure of claim 3 in which said second band joins said insert ply to said top ply.

5. The structure of claim 3 in which said second band joins said insert ply to said bottom ply.

6. The structure of claim 1 in which said adhesive means includes a first band joining said insert ply to said top ply and a second band joining said insert ply to said bottom ply.

7. The structure of claim 1 in which said aligned lines of perforation are spaced approximately ½ inch (12.5 mm) from said other control margin.

8. An elongated assembly having a series of connected stuffed sealed envelopes comprising:

superposed continuous plies having outer side edges constituting control margins, said control margins being equipped with longitudinally aligned, spaced apart line holes, said plies defining between said control margins fronts and backs of sealed envelopes, a rectangular ply within each sealed envelope, said sealed envelopes being defined by transverse lines of weakening in the front and back plies for separating the sealed envelope from the assembly, lines of adhesive securing said front and back plies together along said transverse lines and along a longitudinally extending line inward of one of said control meargins, the periphery of said insert ply being spaced inwardly from said lines of adhesive, aligned lines of perforation in each of said front, back and insert plies extending parallel to but spaced within 1 inch (25.4 mm.) inwardly of the other of said control margins and defining an attaching portion in said insert ply, and a first adhesive band adjacent to said other of said control margins and spaced inwardly thereof joining said front and back plies together and a second adhesive band inwardly of said first band joining said attaching portion to at least one of said front and back plies.

9. A method for making a connected series of stuffed sealed envelope assemblies comprising:

advancing a first elongated web along a predetermined path, said web having at least one line hole equipped control margin extending longitudinally thereof along one edge in a longitudinally extending line of perforation spaced inwardly of said control margin and within about 1 inch (25.4 mm.) thereof, said web being equipped with longitudinally spaced apart attaching spaced between said control margin and said line of perforation, applying generally rectangular insert plies serially on said web, each insert ply having an attaching portion overlying at least a portion of said attaching space, said attaching portion being defined by one marginal edge of said insert ply and a line of perforation spaced inwardly thereof and with said one marginal edge being spaced inwardly of said line holes and while aligning the lines of perforation in said insert plies with the line of perforation in said first web, applying a second elongated web to the insert ply eequipped first web, said second web having a line of perforation aligned with the line of perforation of said first web, said second web also having a series of attaching spaces aligned with attaching spaces of said first web, at least one of said webs, prior to applying said second web being equipped with bands of adhesive for forming a perimeter of adhesive for uniting said webs about each of said insert plies and at least one of said insert plies and webs being equipped with a band of adhesive for uniting each insert ply to one of said webs, and transversely perforating both of said webs between longitudinally adjacent insert plies.

10. A method for making a connected series of stuffed sealed envelope assemblies, comprising:

providing a first continuous web having at least one control margin extending longitudinally thereof along one edge and with a longitudinally extending line of perforation spaced inwardly of said control margin and within about 1 inch (25.4 mm.) thereof, advancing said first web along a predetermined path, providing at least one insert ply web narrower than said first web, said insert ply web being equipped with a marginal edge and a line of perforation spaced inwardly of said marginal edge, severing said insert ply web along longitudinally spaced transverse lines to provide discrete insert plies, serially applying said insert plies to said first web with the line of perforation in each insert ply being aligned with the line of perforation in said first web and with said insert plies being longitudinally spaced apart on said first web, providing a second elongated web equal in width to said first elongated web, said second web being equipped with at least one control margin and a line of perforation spaced inwardly thereof, applying said second elongated web to the insert ply equipped first web with the line of perforation in said second web being aligned with the lines of perforation in said insert plies and first web, prior to application of said second web applying to certain of said webs bands of adhesive for forming a perimeter of adhesive about each of said insert plies and for uniting said first and second webs and said insert ply to one of said first and second webs, and transversely perforating said first and second webs between longitudinally spaced apart insert plies.

11. The method of claim 10 in which a third elongated web is provided for application to the assembly including said first and second webs and constituting an office copy ply, said third elongated web being equal in width to said first and second web and having a control margin along at least one edge thereof, and crimping the control margins of said three webs together incident to transversely perforating said elongated webs.

* * * * *